United States Patent [19]

Ramos et al.

[11] Patent Number: 4,677,262

[45] Date of Patent: Jun. 30, 1987

[54] OPERATOR FOR INTERRUPTERS AND DISCONNECT MECHANISMS

[75] Inventors: Joel A. Ramos; Edward J. Rogers, both of Chicago; Thomas J. Tobin, Northbrook, all of Ill.

[73] Assignee: S&C Electric Company, Chicago, Ill.

[21] Appl. No.: 726,862

[22] Filed: Apr. 25, 1985

[51] Int. Cl.[4] ..... H01H 31/00

[52] U.S. Cl. ..... 200/48 A; 200/153 SC

[58] Field of Search ..... 200/48 A, 48 J, 48 R, 200/153 SC, 47; 185/40 R; 74/2

[56] References Cited

U.S. PATENT DOCUMENTS

| | | | |
|---|---|---|---|
| 3,203,505 | 8/1965 | Hannauer | 200/153 SC |
| 3,333,071 | 7/1967 | Oppel et al. | 200/48 |
| 3,508,178 | 4/1970 | Chabala et al. | 335/1 |
| 3,508,179 | 4/1970 | Bernatt et al. | 335/68 |
| 3,566,055 | 2/1971 | Weston | 200/48 |
| 4,110,579 | 8/1978 | Frink et al. | 200/153 SC |

FOREIGN PATENT DOCUMENTS

| | | | |
|---|---|---|---|
| 402543 | 1/1965 | Australia | 200/153 SC |

OTHER PUBLICATIONS

"S&C Switch Operator—Moto-Draulic Type", S&C Electric Company Photo Sheet 740-4.1, Sep. 23, 1968, 2 pages.

"Switch Operating Mechanism", H. K. Porter Catalog No. 1-160, Apr. 1971, 4 pages.

"MO-10 Motor Operator", I-T-E Imperial Corporation, Catalog Section 13.4.1.1-13.4.1.2., Aug. 30, 1968, 5 pages.

"Type CM-4A Motor Operating Mechanism", Siemens-Allis Brochure DS 4.2, Jun. 1983, 8 pages.

*Primary Examiner*—Stephen Marcus
*Assistant Examiner*—Linda J. Sholl
*Attorney, Agent, or Firm*—James V. Lapacek

[57] ABSTRACT

An operator is provided that includes a common drive for charging an operating mechanism and for driving a functional accessory device in predetermined coordinated relationship. The common drive in a specific embodiment is provided as a drive shaft at the output of a drive train. The operating mechanism is charged as the drive shaft is rotated from a first to a second predetermined position. The functional accessory device is also driven via the drive shaft; the functional accessory device being operated from a first predetermined operational state to a second predetermined operational state in response to the rotation of the drive shaft between the predetermined positions. When desired, the functional accessory device is operated from the second predetermined operational state to the first predetermined operational state by subsequent rotation of the drive shaft to the first predetermined position. The operating mechanism is controlled thereafter to close the contacts of one or more interrupting units. The operating mechanism is capable of immediately opening the contacts of the one or more interrupting units after closing. After opening of the contacts of the interrupting unit and when desired, the drive shaft is rotated from the first to the second predetermined position to again charge the operating mechanism and drive the functional accessory device to the second predetermined operational state. In one embodiment of the operator, a charging cam is carried by the drive shaft for charging the operating mechanism. The charging cam, in a specific embodiment, includes a predetermined cam surface that cooperates with the operating mechanism to inhibit movement of the drive shaft and thus inhibits operation of the functional accessory device when the motor of the drive train is deenergized. In one arrangement, the functional accessory device is one or more disconnects with a disconnect being connected in series circuit with each interrupting unit.

13 Claims, 9 Drawing Figures

116
190
64
112
150
156
154
46
198
194
196
114
110
152
18
48'

116
152
112
182
194
180
16
110
168
114
178
18

16
152
178
170
172
158
162
176
156
160
190
174
168
164
160

OPERATOR FOR INTERRUPTERS AND DISCONNECT MECHANISMS

CROSS-REFERENCE TO RELATED APPLICATIONS

This application is directed to an improved operator which is suitable for use with the operating mechanism, base drive linkage, insulating support columns, various linkage arrangements, and circuit protection device configurations disclosed and claimed in commonly-assigned, co-pending application Ser. Nos. 721,617 (U.S. Pat. No. 4,636,602), 721,616 (U.S. Pat. No. 4,596,906), and 721,614 filed in the names of W. J. Hall et al. and L. V. Chabala et al. respectively on Apr. 10, 1985, application Ser. Nos. 721,617 and 721,616 being incorporated by reference in this application for all purposes.

BACKGROUND OF THE INVENTION

1. Field of the Invention

The present invention relates generally to the field of electrical circuit protection configurations and more particularly to an improved operator having a common drive output for charging an operating mechanism and for driving one or more functional accessory devices in predetermined, coordinated relationship.

2. Description of the Related Art

Various arrangements are known for operating circuit protection devices including interrupters and disconnect mechanisms. For example, U.S. Pat. Nos. 3,508,178, 3,566,055 and 4,110,579 disclose several types of operators and related drive arrangements.

While these arrangements are generally suitable for their intended purpose, it is desirable to provide improved operators especially for use with circuit protection device configurations disclosed and claimed in U.S. application Ser. No. 721,614 filed on Apr. 10, 1985 in the names of L. V. Chabala et al. Configurations of this type require facilities for the operation of an interrupting unit and facilities for the operation of a disconnect mechanism, in predetermined coordinated operating relationships.

SUMMARY OF THE INVENTION

Accordingly, it is a principal object of the present invention to provide an improved operator including a common drive for charging an operating mechanism and for controlling the operational state of a functional accessory device.

It is another object of the present invention to provide an operator having an output drive shaft that carries a charging cam and that drives a disconnect linkage; the operator being arranged to provide coordinated operation to charge an operating mechanism and to operate one or more disconnect mechanisms.

It is a further object of the present invention to provide an improved operator having a drive shaft that carries a charging cam and that drives a disconnect linkage; the operator inhibiting movement of the charging cam and the drive shaft in one or more predetermined rotational positions of the drive shaft to maintain the disconnect linkage in a corresponding operative state.

Briefly, these and other objects and advantages of the present invention are efficiently achieved by providing an operator that includes a common drive for charging an operating mechanism and for driving a functional accessory device in predetermined coordinated relationship. The common drive, in a specific embodiment, is provided as a drive shaft at the output of a drive train. The operating mechanism is charged as the drive shaft is rotated from a first to a second predetermined position. The functional accessory device is also driven via the drive shaft; the functional accessory device being operated from a first predetermined operational state to a second predetermined operational state in response to the rotation of the drive shaft between the predetermined positions. When desired, the functional accessory device is operated from the second predetermined operational state to the first predetermined operational rotation of the drive shaft to the first predetermind position. The operating mechanism is controlled thereafter to close the contacts of one or more interrupting units. The operating mechanism is capable of immediately opening the contacts of the one or more interrupting units after closing. After opening of the contacts of the interrupting unit and when desired, the drive shaft is rotated from the first to the second predetermined position to again charge the operating mechanism and drive the functional accessory device to the second predetermined operational state. In one embodiment of the operator, a charging cam is carried by the drive shaft for charging the operating mechanism. The charging cam, in a specific embodiment, includes a predetermined cam surface that cooperates with the operating mechanism to inhibit movement of the drive shaft and thus inhibits operation of the functional accessory device when the motor of the drive train is deenergized. In one arrangement, the functional accessory device is one or more disconnects with a disconnect being connected in series circuit with each interrupting unit.

BRIEF DESCRIPTION OF THE DRAWING

The invention, both as to its organization and method of operation, together with further objects and advantages thereof, will best be understood by reference to the following specification taken in conjunction with the accompanying drawing in which like reference numerals refer to like elements and in which.

DETAILED DESCRIPTION

Figures 1, 2, 3, 4:
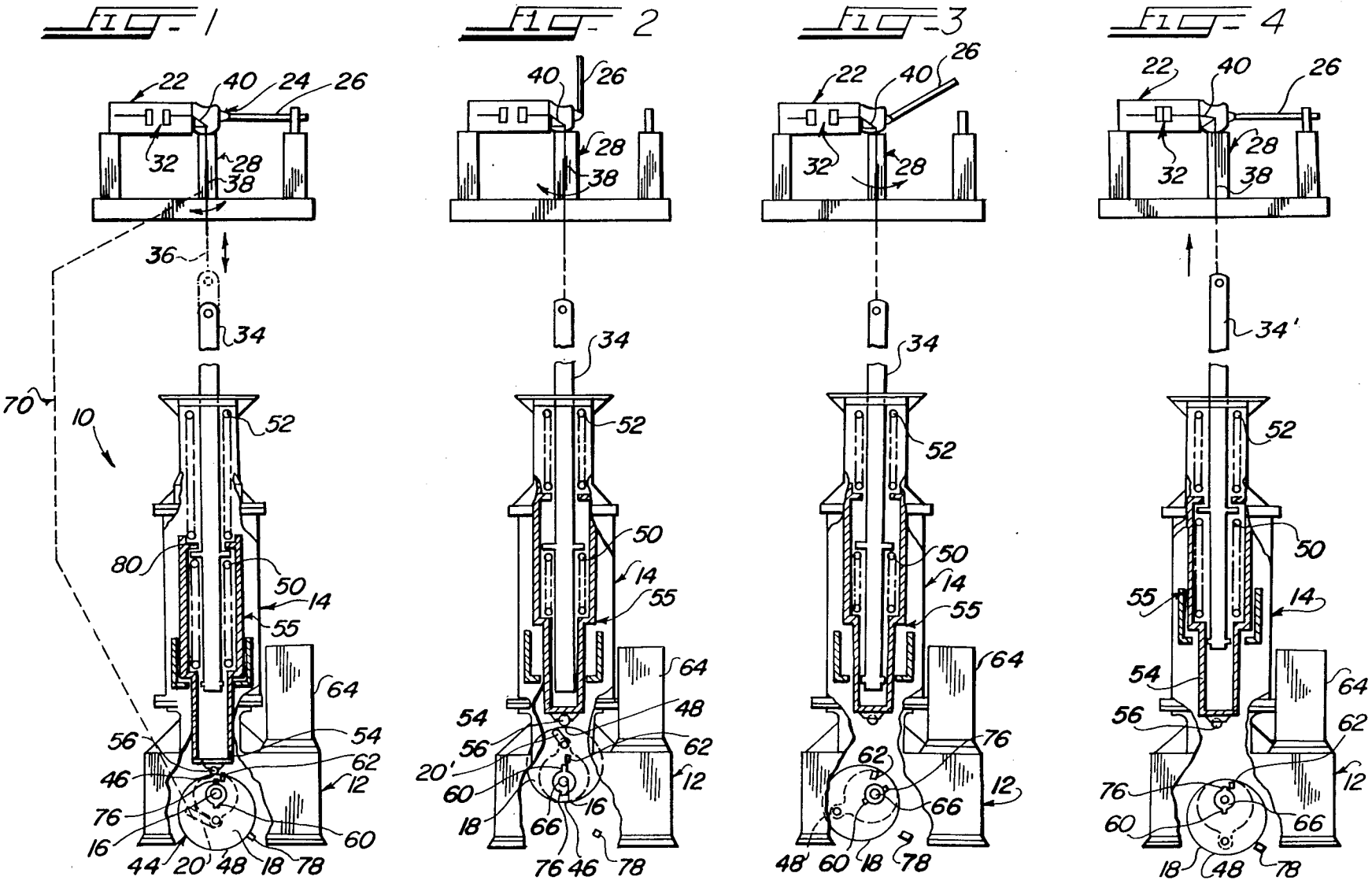
FIGS. 1–4 are diagrammatic representations of the operator of the present invention illustrating various operational states of a controlled circuit-protection device.
Figure 6:
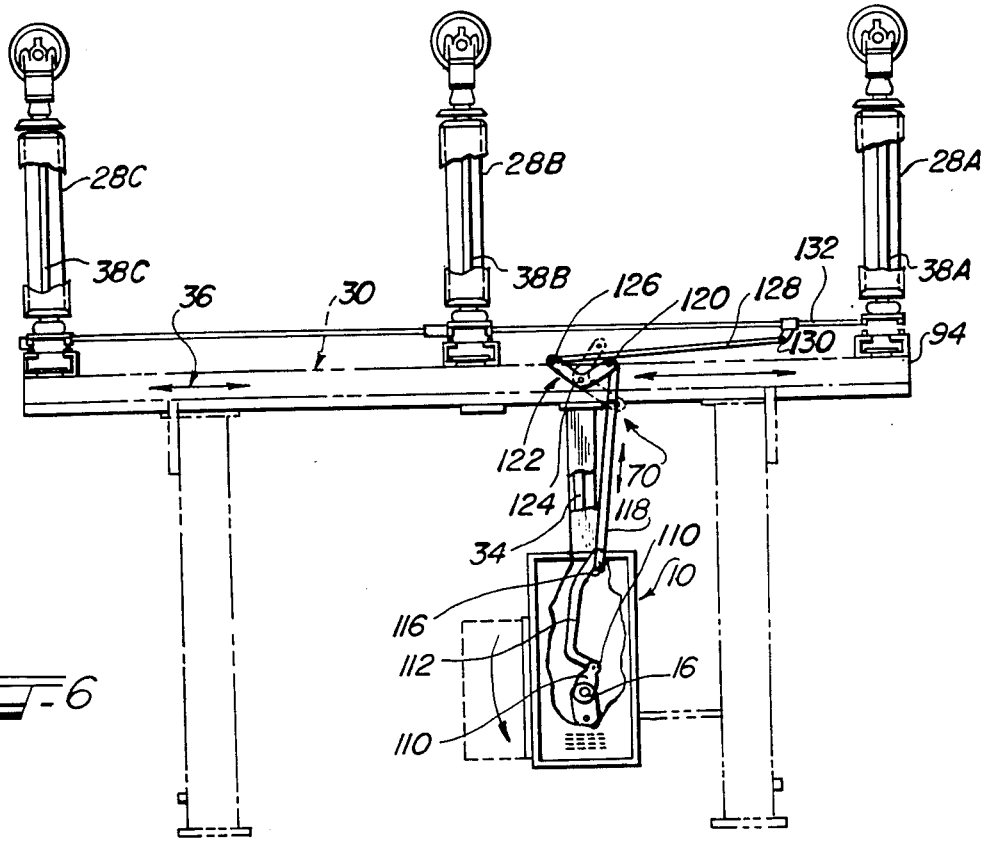
FIGS. 5 and 6 are elevational views of the operator of the present invention utilized with an illustrative circuit-protection device configuration.
Figure 5:
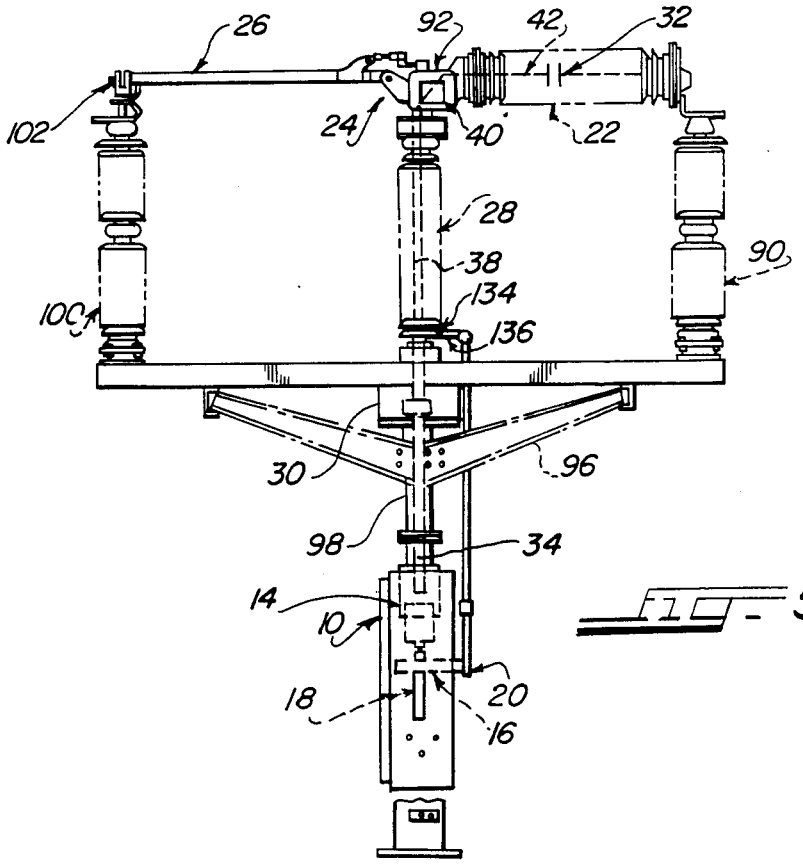

Referring now to FIGS. 1, 5 and 6 and considering first the basic function and structure of the present invention, an operator 10 includes a drive section 12 and an operating mechanism 14. For illustrative purposes and not in any limiting sense, the operator 10 is shown in FIGS. 5 and 6 for operating one or more interrupting units 22 and one or more disconnect mechanisms 24 in predetermined coordinated relationship. The drive section 12 includes an output drive shaft 16 for charging the operating mechanism 14 and for driving a functional accessory device. In the specific illustrated embodiment, the drive shaft 16 carries a charging cam 18 for charging the operating mechanism 14 and also drives an attached disconnect linkage at 20. However, it should be realized that the drive section 12 can be utilized with various operating mechanisms and circuit-protection device configurations. Further, it should also be realized that the drive shaft 16 in other embodiments charges the operating mechanism 14 through other suitable means such as a rack and pinion mechanism that is driven by the shaft 16. A cam is desirable since the cam radius versus rotational position can be selected to coordinate with the spring rates of the operating mechanism 14 to provide a uniform load on the drive section 12. Additionally, the disconnect mechanism 24 or other functional accessory device may be driven by drive arrangements that are in turn driven by the shaft 16.

In the illustrative arrangement of FIGS. 1, 5 and 6, the disconnect linkage connected at 20 is arranged to open and close a disconnect blade 26 of the disconnect mechanism 24 by rotation of the insulating support column 28 which is rotatably mounted with respect to the base 30. After being charged by the charging cam 18, the operating mechanism 14 is selectively controllable to close and open the contacts 32 of the interrupting unit 22 by means of reciprocation of a common operating member 34. The common operating member 34 is connected through a base drive referred to generally at 36 to reciprocate operating members 38 carried by each of the insulating support columns 28. The operating member 38 is connected through a bell crank 40 to reciprocate an actuating member 42 of the interrupting unit 22. Accordingly, reciprocation of the elements 34,36,38 and 42 between operative positions causes opening and closing of the interrupter contacts 32.

Considering now the manner in which the operator 10 of the present invention provides the predetermined coordinated operation of the disconnect mechanism 24 and the interrupting unit 22 and referring now to FIGS. 1–4, the operator 10 is shown in FIG. 1 in a first predetermined operating position with the output shaft 16 positioned to define a disconnect-closed position of the disconnect linkage at 20 with the charging cam 18 positioned in a ready-to-charge position. The charging cam 18 includes an eccentric cam surface 44 that defines an increasing radial dimension with respect to the drive shaft 16 between a minimum point 46 and a maximum point 48. In FIG. 1, the operating mechanism 14 is shown in an uncharged position with both a closing spring 50 and an opening spring 52 in the discharged position. In this condition, a carriage portion 54 of a carriage 55 is in a lower position in contact with the minimum point 46 of the charging cam 18 via a roller 56 extending from the lower end of the carriage portion 54. The common operating member 34 is shown in FIG. 1 in the lower position corresponding to the open state of the contacts 32 of the interrupting unit 22.

When it is desired to close the contacts 32 of the interrupting unit 22, the sequence of FIGS. 2 to 3 to 4 describes the corresponding sequential operation including opening the disconnect blades 26 as shown in FIG. 2, followed by closing the disconnect blades 26 as shown from the sequence of FIG. 3 to FIG. 4, and then releasing the common operating member 34 with the closing spring 50 moving the common operating member 34 to the upper position 34' to close the contacts 32 of the interrupting unit 22. If a fault condition is detected after the closing of the contacts of the interrupting unit 22, the carriage 55 is released and the opening spring 52 moves the carriage 55 and the common operating member 34 to the lower position in FIG. 1 to open the contacts 32 of the interrupting unit 22 as shown by the sequence of FIG. 4 to FIG. 1. In the condition of FIG. 1, the operating mechanism 14 is again ready for charging.

In the charging sequence from FIG. 1 to FIG. 2 with the operating member 34 latched against movement in the upper, switch-closing direction, as the charging cam 18 is rotated with the drive shaft 16, the cam 18 provides a lifting force to the carriage portion 54 as the increasing eccentric cam surface 44 contacts the roller 56. The carriage 55 is raised until the position of FIG. 2 is reached with operating energy being stored in the opening spring 52 and the closing spring 50. In this position, the carriage 55 is latched against movement in the downward, switch-opening direction. Rotation of the drive shaft 16 is stopped in the position of FIG. 2 by means of a first actuator 60 engaging a switch 62 to deenergize the motor 64; the motor 64 being connected to drive the output shaft 16 through an appropriate gear train as will be explained in more detail hereinafter. The first actuator 60 is carried by a switch cam 66 affixed to the drive shaft 16; the relative position of the first contactor 60 and the switch 62 being arranged to activate the switch 62 in the position of FIG. 2. As the drive shaft 16 is rotated from the position of FIG. 1 to the position of FIG. 2, the disconnect linkage at 20 is also rotated to the position 20' of FIG. 2 to open the disconnect blade 26 via the linkage referred to generally at 70.

When it is desired to close the series circuit through the contacts 32 of the interrupting unit 22 and the disconnect blades 26, the motor 64 is reenergized by operation of an additional switch (not shown) that operates in parallel with the switch 62. In the specific arrangement illustrated in FIGS. 1–6, the motor 64 is operated in reverse to rotate the shaft 16 back to the position of FIG. 1. The reverse rotation is desirable in accordance with the specific illustrated disconnect linkage 20,70. However, it should also be realized that with other suitable disconnect linkage, the shaft 16 is rotated through 360 degrees back to a 0 degree starting position of FIG. 1 rather than to 180 degrees and reversed back to a 0 degree starting position. In any event, the sequence of FIGS. 2 to 3 to 4 follow energization of the motor 64; FIG. 3 illustrating a position that is interim FIGS. 2 and 4 whereat the disconnect blade is between the fully-opened position of FIG. 2 and the fully-closed position of FIG. 4. When the disconnect-closed position of FIG. 4 is reached, the motor 64 is again deenergized via a second actuator 76 engaging the switch 62. Accordingly, the drive shaft 16 is stopped in the position of FIG. 4 which is the same as the starting position of FIG. 1. Further, a sense switch 78 is positioned to be contacted by the charging cam 18 as the cam 18 reaches the starting position. The state of the sense switch 78 is utilized to prevent closing of the interrupting unit 22 unless the disconnect blade 26 is in the fully-closed position; the specific illustration being desirably operated so that circuit-path closing occurs in the interrupting unit 22 and not by the disconnect blade 26.

When the sense switch 78 indicates that the charging cam 18 is in the position corresponding to the disconnect linkage 20,70 and the disconnect blades 26 being in the closed position, the latch on the carriage 54 is released by suitable operator controls. When the carriage 55 is released, the opening spring 52 moves the carriage 54 and the operating member 34 to the lower position of FIG. 1 to open the contacts 32 of the interrupting units 22; the carriage 54 moving against the common operating member 34 at 80. In the position of FIG. 1, the operator 10 is again ready for the charging and blade-opening sequence and subsequent blade closing and interrupting unit closing.

Considering now the use of the operator 10 of the present invention with the illustrative circuit protection device configuration of FIGS. 5 and 6, the operator 10 is illustrated for three-phase connections with simultaneous operations of the three disconnect mechanisms 24 by rotation of the insulating support columns 28 via the disconnect linkage 70 connected at 20 to the drive shaft 16. As discussed hereinbefore, the charging cam 18 charges the operator mechanism 14 while the disconnect blades 26 are being opened. The base drive 36 is driven by the common operating member 34 of the operator mechanism 14 to close the contacts 32 of the interrupting units 22 as desired and is capable of immediately thereafter opening the contacts 32 if a fault condition is sensed or as required by other control inputs by releasing the carriage 55 with the opening spring 52 driving the carriage 55 and the common operating member 34. The base drive 36 via the operating member 34 provides high-speed operation of the contacts 32 of the interrupting units 22 for desirable operating parameters. In comparison, the output drive shaft 16 operates relatively slowly so as to provide a low-speed drive to the disconnect linkage 70 to rotate the insulating support column 28 to open and close the disconnect blades 26 via the disconnect mechanism 24 in coordination with the rotation of the charging cam 18 between the operative positions.

The illustrative configuration of FIGS. 5 and 6 include a support insulator 90 to support one end of each interrupting unit 22 with the second end of the interrupting unit 22 being supported by a translation housing 92 atop each insulating support column 28. The support insulators 90 are each affixed to a respective support member 94 running transverse to and supported by the base support member 30. Cross arms 96 are provided on a pedestal 98 which supports the base support member 30. A support insulator 100 is provided for alignment with the end of each disconnect blade 26 when in the closed position. Each support insulator 100 carries a disconnect contact 102 for engagement by the disconnect blade 26 and for circuit connection. The support insulators 100 are each affixed to the support member 94. Reference may be made to co-pending application Ser. Nos. 721,617, 721,616 and 721,614 for a more detailed discussion of the base drive 36, the insulating support columns 28, the translation housing 92 and various circuit-protection device configurations.

The disconnect linkage 70 includes a lever 110 affixed to the drive shaft 16 and an arcuate drive-coupling member 112 pivotally mounted at 114 to the lever 110. The drive-coupling member 112 includes a socket 116 at the outer end thereof which is arranged to interfit and accept one end of a drive rod 118. The other end of the drive rod 118 is pivotally connected at 120 to one arm of a bell crank 122. The bell crank is pivotally mounted at 124 with respect to the base support member 30. A second arm of the bell crank 122 is pivotally mounted at 130 to drive member 132. The drive member 132 spans the three insulating support columns 28A,B,C and is connected to the base support member 134 of each insulating support column via a drive arm 136 extending from the base member 134. Accordingly, rotation of the drive shaft 16 between the two operative positions pivots the bell crank 122 to rotate the insulating support columns 28A,B,C; vertical reciprocation of the drive rod 118 being translated to horizontal reciprocation of the drive member 132. As discussed hereinbefore, rotation of the insulating support columns 28A,B,C is converted to lifting motion of the disconnect blades 26 by the disconnect mechanisms 24; a disconnect mechanism of this type being disclosed in U.S. Pat. No. 3,508,178. Thus, rotation of the drive shaft 16 between the two positions provides selective opening and closing of the disconnect blades 26.

Figure 7:
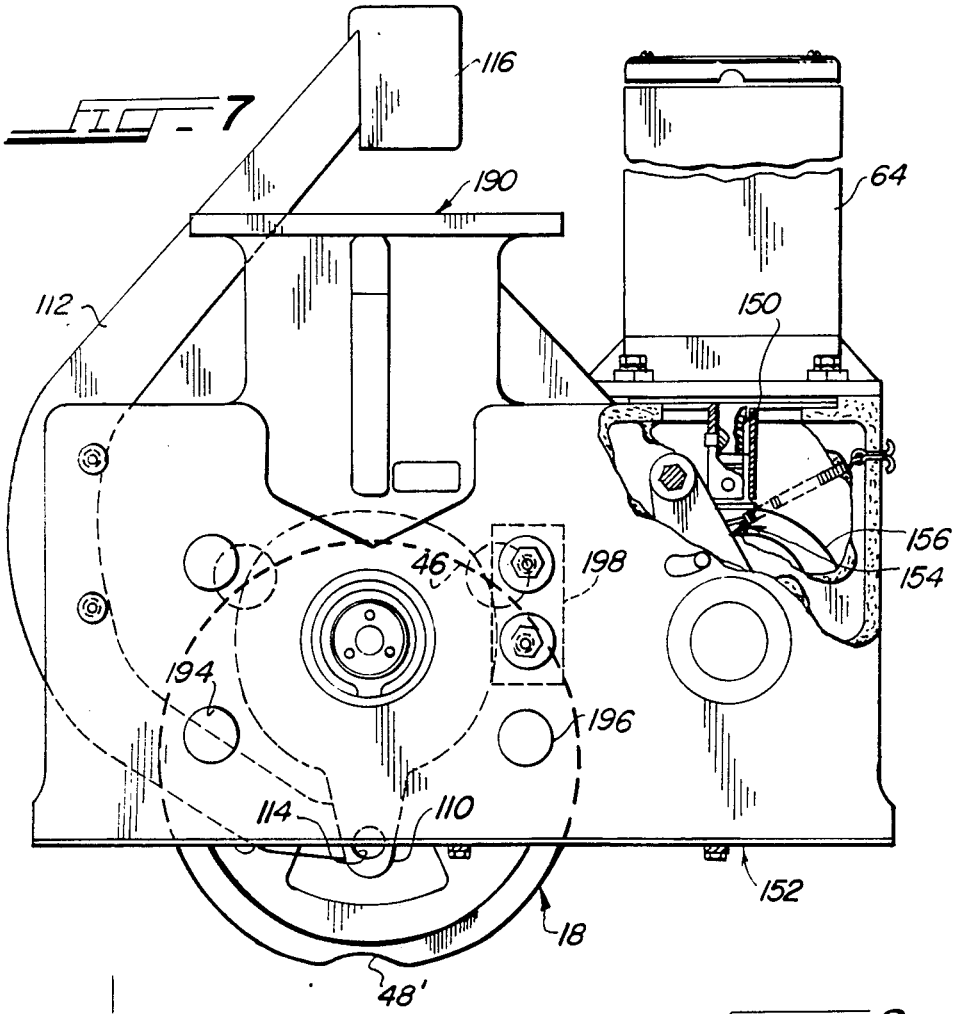
FIGS. 7–9 are front, side and plan elevational views, partly in section and with parts cut away, of the drive section of the operator of the present invention.
Figure 9:
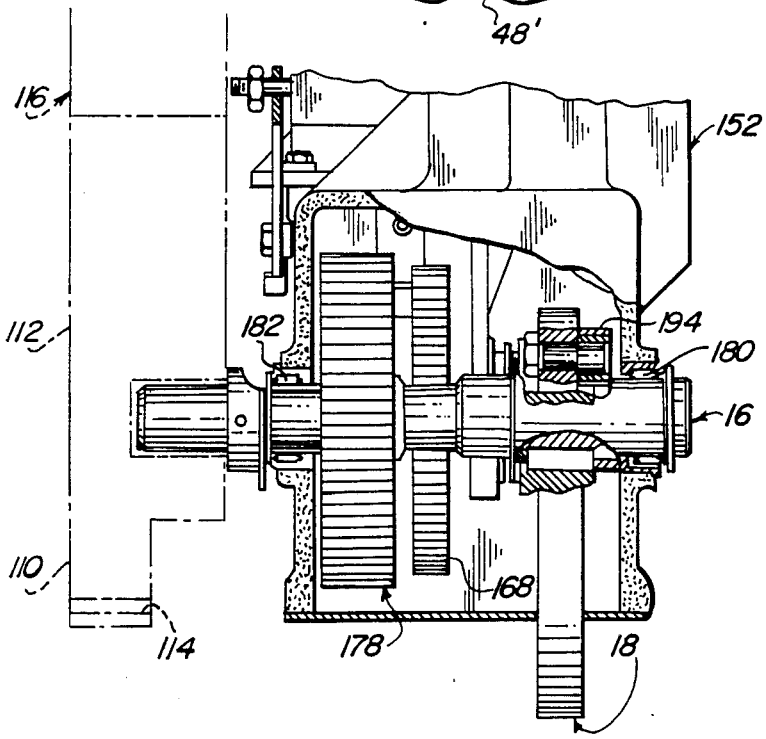
Figure 8:
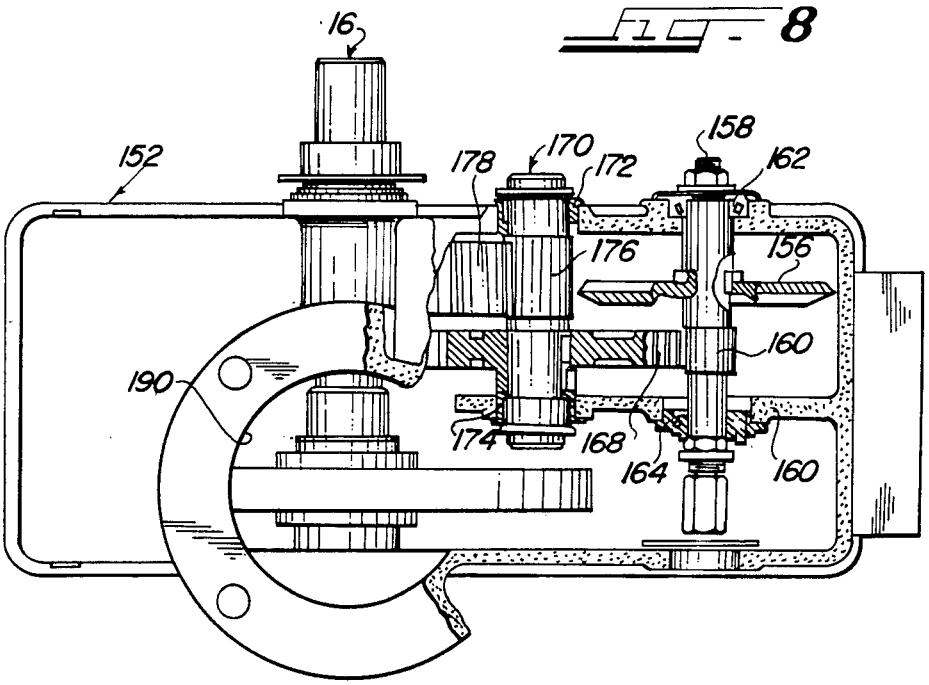

Considering now a more detailed discussion of the drive section 12 of the operator 10 of the present invention and referring now to FIGS. 7–9, the motor 64 of the drive section 12 includes an output shaft 150 that extends into the housing 152 and carries a pinion 154. The pinion 154 drivingly engages a first gear 156. The first gear 156 is affixed to a first shaft 158 (FIG. 8) that is rotatably mounted with respect to the housing 152 and a housing wall 160 by means of suitable bearings at 162 and 164 respectively. The first shaft 158 carries a second gear 166 or geared shaft portion that drivingly engages a larger, third gear 168. The third gear 168 is affixed to a second, intermediate shaft 170. The second shaft 170 is rotatably mounted with respect to the housing 152 and the housing wall 160 by suitable bearings 172 and 174 respectively. The second shaft 170 carries a fourth gear 176 or geared shaft portion that drivingly engages a larger, fifth gear 178. The fifth gear 178 is affixed to the output drive shaft 16. The output drive shaft 16 is rotatably mounted with respect to the housing 152 by means of suitable bearings 180 and 182 (FIG. 9). The output drive shaft also fixedly carries the charging cam 18 as discussed hereinbefore. The ratio of gears 154 to 156, 166 to 168, and 176 to 178 provides a desirable reduction ratio between the speed of operations of the motor 64 and the speed of rotation of the output drive shaft 16.

The housing 152 includes a receiving chamber 190 into which the carriage portion 54 extends for contact with the charging cam 18. The lever 110 is carried by the output drive shaft 16 and pivotally carries the drive coupling member 112 as discussed hereinbefore. For the specific arrangements wherein the charging cam 18 is rotated 180 degrees in one direction and reversed to rotate back to the starting position, a mechanical stop or travel-limit arrangement is provided to appropriately limit rotation of the charging cam 18 between the two positions. For example, the stop arrangement (FIG. 9) is provided by affixing two protruding members 194 and 196 to the charging cam 18 and appropriately positioning a protruding stop plate 198 with a shock absorber that extends from the housing 152.

In accordance with another feature of the present invention, the charging cam 18 is provided with a predetermined contour or cam-surface characteristics at 48 that is aligned at the highest portion of the cam surface 44 so as to engage the carrige portion 54 at the roller 56 in the charged position of FIG. 2. The cam surface at 48 is defined in a specific embodiment by a chord across two points of the charging cam 18 providing a flat portion. In other embodiments, various other contour or cam-surface characteristics are utilized for providing a net decrease in the cam radius from the drive shaft 16. FIG. 7 illustrates another specific embodiment of the portion 48' as a detent in the cam surface 44. The portion 48 in combustion with the carriage 55 of the operating mechanism 14 provides a mechanical limit, detent arrangement or brake on the drive shaft 16, the disconnect linkage 70 and the disconnect blades 26. For example, in the disconnect blade-open position of FIG. 2, the disconnect blades 26 are held in the open position by the action of the operating mechanism 14 against the charging cam 18 at 48. Specifically, with the motor 64 deenergized, the charging cam 18 cannot rotate out of the position of FIG. 2 without exerting a force to move the carriage portion 54. The carriage portion 54 is latched against movement in the downward direction in FIG. 2 but the charging cam 18 works against the springs 50 and 52 so as to require further charging force by the charging cam 18 to lift the carriage 55. Accordingly, no additional brake or locking mechanism is required to maintain the disconnect blades 26 in the open position of FIG. 2. Further, since the effecive working radius of the charging cam 18 increases in either direction from the minimum point 46, a similar detent or brake effect is provided for the disconnect blades 26 when in the closed position. Of course, it should be realized that in specific arrangement, additional locking mechanisms may be provided to operate in parallel with the arrangement provided by the charging cam 18.

The drive coupling member 112 is arranged with respect to the output shaft 16 and the pivot point 114 on the lever 110 so as to be in an over-center condition in both the blade-open position of FIG. 2 and the blade-closed position of FIG. 1. Accordingly, the charging cam 18 cannot be driven through the disconnect linkage 70; thereby providing an over-center toggle or detent arrangement. For example, any force exerted through the disconnect linkage 70 tends to inhibit movement of the shaft 16; i.e. rotate the shaft in the direction opposite to that for releasing and moving to the disconnect linkage. This over-center toggle or detent arrangement further prevents any unwanted movement of the disconnect blades 26, the charging cam 18, or the drive shaft 16. Regarding the prevention of movement of the disconnect blades 26, the arrangement also is operative in the situation where the lever 110 becomes free to move about the shaft 16 or where the shaft is free to rotate. Additionally, the stop or travel-limit arrangement on the charging cam 18 also provides a mechanical stop or travel-limit arrangement for the disconnect linkage 70; any force that is exerted through the disconnect linkage tending to hold the charging cam 18 against one of the stops.

While there has been illustrated and described various embodiments of he present invention, it will be apparent that various changes and modifications will occur to those skilled in the art. Accordingly, it is intended in the appended claims to cover all such changes and modifications as fall within the true spirit and scope of the present invention.

What is claimed and desired to be secured by Letters Patent of the United States is:

1. An operator for remotely operating a plurality of disconnect mechanisms via a disconnect-mechanism operating linkage and a plurality of interrupting units via an interrupting-unit operating linkage that operates at a much higher speed than the disconnect-mechanism operating linkage, the operator including an operating mechanism that is charged to store operating energy, said operating mechanism including a first output that drives the plurality of interrupting units via the interrupting-unit operating linkage, the operator further including a drive member for providing a second output that drives the plurality of disconnect mechanisms via the disconnect-mechanism operating linkage and a third output that charges said operating mechanism, said second and third outputs being coordinated to each other in accordance with the position of said drive member.

2. The operator of claim 1 wherein said drive member is a rotatable drive shaft.

3. The operator of claim 2 further comprising a motor having a rotational output and a drive train responsive to said rotational output for driving said drive shaft, said drive train defining a predetermined reduction ratio between said rotational output and said drive shaft.

4. The operator of claim 2 wherein said rotatable drive shaft is connected to said disconnect-mechanism operating linkage.

5. The operator of claim 2 further including a cam carried by said rotatable drive shaft for providing said third output as a lifting force to charge said operating mechanism.

6. The operator of claim 5 wherein said operating mechanism exhibits a force versus displacement characteristic at said third output, said cam including a predetermined cam contour to prevent rotation of said drive shaft when said cam is at one or more predetermined positions in contact with said operating mechanism at said third output.

7. The operator of claim 6 further including means for limiting movement of said cam beyond a predetermined position.

8. The operator of claim 2 wherein said cam includes a cam contour that defines an increasing radius for rotation of said cam about a predetermined position.

9. The operator of claim 1 wherein said first output provides translational movement of said interrupting-unit operating linkage between predetermined first and second positions.

10. The operator of claim 9 wherein said second output provides rotational movement between predetermined third and fourth positions.

11. An electrical circuit protection configuration comprising:

a plurality of interrupting units;

a plurality of disconnect mechanisms;

an interrupting-unit operating linkage arranged to operate said plurality of interrupting units;

a disconnect-mechanism operating linkage arranged to operate said plurality of disconnect mechanisms; and an operator, said operator including an operating mechanism that is charged to store operating energy, said operating mechanism including a first output for driving the interrupting-unit operating linkage, said operator further including a drive member for providing a second output to drive the disconnect-mechanism operating linkage and a third output for charging said operating mechanism, said second and third outputs being coordinated to each other in accordance with the position of said drive member.

12. The operator of claim 11 wherein each of said disconnect mechanisms includes a movable disconnect blade.

13. The operator of claim 12 wherein each of said interrupting units includes a pair of contacts, each of said movable disconnect blades being connected in series with said contacts of a respective interrupting unit.

* * * * *

UNITED STATES PATENT AND TRADEMARK OFFICE

CERTIFICATE OF CORRECTION

PATENT NO. : 4,677,262

DATED : June 30, 1987

INVENTOR(S) : Joel A. Ramos, et al

It is certified that error appears in the above-identified patent and that said Letters Patent is hereby corrected as shown below:

Col. 2, line 13, after "operational" add --state by subsequent--;

Col. 5, lines 32 & 33, "include" should be --includes--;

Col. 6, line 66, "combustion" should be --combination--;

Col. 7, line 48, "he" should be --the--.

Signed and Sealed this

Twenty-ninth Day of December, 1987

*Attest:*

DONALD J. QUIGG

*Attesting Officer*

*Commissioner of Patents and Trademarks*